US005772391A

United States Patent [19]

Sjogren et al.

[11] Patent Number: 5,772,391

[45] Date of Patent: Jun. 30, 1998

[54] STACKER FOR COUNTING AND STACKING SIGNATURES DELIVERED BY A GRIPPER CONVEYOR

[75] Inventors: Christer A. Sjogren, Miami; Medardo Espinosa, Hialeah, both of Fla.

[73] Assignee: Quipp Systems, Inc., Miami, Fla.

[21] Appl. No.: 561,694

[22] Filed: Nov. 22, 1995

[51] Int. Cl.[6] ..... B65H 29/04

[52] U.S. Cl. ..... 414/790.9; 414/790.4; 414/791.1; 414/793.9; 198/470.1; 198/78

[58] Field of Search ..... 414/790.9, 791, 414/791.1, 792.9, 793.5, 793.6, 793.8, 793.9, 790.4; 198/470.1

[56] References Cited

U.S. PATENT DOCUMENTS

| | | | |
|---|---|---|---|
| 3,532,230 | 10/1970 | Gutberlet et al. | 414/791 |
| 3,599,807 | 8/1971 | Hedrick | 414/791 |
| 4,666,143 | 5/1987 | Reist | 271/204 |
| 4,968,081 | 11/1990 | Beight et al. | 198/470.1 |
| 5,218,813 | 6/1993 | Seidel | 53/399 |
| 5,328,323 | 7/1994 | Molison | 414/791.1 |
| 5,338,149 | 8/1994 | Wiseman | 414/793.6 |
| 5,388,820 | 2/1995 | Eberle et al. | 198/470.1 |

*Primary Examiner*—James W. Keenan
*Assistant Examiner*—Gregory A. Morse
*Attorney, Agent, or Firm*—Louis Weinstein

[57] ABSTRACT

Signatures are delivered to a stacker by a gripper conveyor, each gripper delivering a signature thereto. The grippers follow a curved path adjacent to the stacker, substantially aligning the signatures with the stacking platform receiving signatures as they are released. A plurality of stacking platforms are moved about a closed loop path, each independently driven by an associated drive motor. The speed of each stacking platform is variable and is synchronized with the throughput of the gripper conveyor as well as signature thickness. When a predetermined quantity of signatures has been collected, an upstream stacking platform is moved between the last signature of the preceding stack and the first signature of the next stack. When a stack has been completed, the stacking platform is quickly pulled away from the signature stack allowing it to fall by gravity into a collector, and is thereafter moved quickly to the ready position in preparation for forming a subsequent signature stack. The stacker has three stacking platforms independently driven by an associated motor. Three drive chain sets arranged to move about only two shafts each drive an associated stacking platform.

28 Claims, 10 Drawing Sheets

STACKER FOR COUNTING AND STACKING SIGNATURES DELIVERED BY A GRIPPER CONVEYOR

FIELD OF THE INVENTION

The present invention relates to apparatus for counting and stacking signatures and the like, and more particularly to novel apparatus for accurately counting and neatly stacking signatures in which signatures are directly conveyed to the stacker by a gripper conveyor to provide a positive control over each and every signature.

BACKGROUND OF THE INVENTION

The importance of providing devices which can accurately track, count and stack individual signatures moved from sources such as an inserting machine to their destination point cannot be overemphasized. One of the major applications for gripper conveyors is to take away signatures from an inserter. Inserters are large scale machines capable of inserting a plurality of inserts into a newspaper. In one typical application, is in the preparation of Sunday newspapers, which typically have a large number of inserts. The inserts are placed into each Sunday edition by the inserter machinery, and after insertion, are taken away from the inserter by grippers, each gripper holding one signature by its cut edges (i.e. with folded edge down). Thereafter, the signatures, which are taken away from the inserter, are dropped from their grippers upon a belt conveyor just prior to delivery to a stacker. The gripper conveyor advances each of the grippers by means of an endless flexible chain to which the grippers are attached, as well as a guide frame for guiding the chain and grippers along a given delivery path. The grippers release each signature to be dropped upon a belt conveyor prior to reaching a designated stacker, the belt conveyor delivering the signatures directly to an infeed section of the stacker. Problems result from this design due to the fact that the signatures are no longer under control, and as they are dropped, their whereabouts on the belt conveyor is not known. The effects of gravity, signature shape and velocity make it difficult to accurately predict trajectories and positions, thereby complicating the accurate counting and neat stacking of signatures.

BRIEF DESCRIPTION OF THE INVENTION

The present invention is characterized by comprising a stacker and cooperating gripper conveyor designed in accordance with the principles of the present invention whereby the belt conveyor is completely eliminated and the gripper conveyor is designed to cooperate with a novel stacker to provide accurate counting and neat stacking of signatures.

The present invention, in a preferred embodiment, comprises a gripper conveyor cooperating with a signature stacker. The gripper conveyor is comprised of individual grippers coupled at spaced intervals to an endless flexible chain. Guideways supported by a frame guide the chain and the grippers along a predetermined delivery path between an inserter and the stacker, which delivery path preferably includes a substantially S-shaped configuration including an initial downwardly curved portion to bring grippers moving therealong immediately in front of a stacking region.

Each gripper holds a signature by its cut edge, each signature being aligned basically vertical with the folded edge suspended downwardly.

The stacker is comprised of a plurality of stacking platforms, at least two and preferably three or more in number, so that at least one of the stacking platforms is receiving and stacking signatures while at least one other stacking platform is either in an intercept-ready position or is rapidly moved to an intercept-ready position and thereafter to move the stacking platform in the intercept-ready position into the path of signatures and between the last signature to be stacked on the stacking platform presently moving through the stacking region, and the first signature to be stacked upon the stacking platform intercepting the conveyor stream.

The stacking platforms are guided along a common, closed-loop guide path, each stacking platform being independently driven at a variable speed by an associated drive motor, the speed being a function of the delivery speed of the gripper conveyor and signature thickness, as well as other criteria.

A stop device, which is located in close proximity to a release mechanism of the grippers, controls the movement of released signatures, causing them to be guided downwardly after their release to form a neat stack upon the stacking platform moving along the stacking region.

The speed of movement of the stacking platform through the stacking region is controlled primarily by the gripper conveyor throughput and signature thickness.

When the desired count of signatures to be stacked thereon is reached, the next upstream stacking platform in the intercept-ready or home position is quickly moved into a position between the last signature to be received by the stacking platform in the stacking region, and the first signature to be stacked on the intercepting stacking platform.

When the stacking platform presently receiving signatures passes through the lower end of the stacking region and enters into the drop ready region, the speed of the stacking platform is increased so that the stacking platform is rapidly pulled away from beneath the signature stack formed thereon, enabling the signature stack to drop into an accumulating or collector means directly below the stacking region.

The stacking platform which has released a signature stack is then rapidly moved toward the intercept position in readiness to perform the next intercept operation. In order to increase the throughput of the stacker and to accommodate gripper conveyors having high throughput, it is preferred that the stacker be provided with three or more stacking platforms.

The stacker incorporates a novel design which supports a plurality of independently movable sets of drive chains each associated with a stacking platform. In one embodiment, three sets of independently moveable drive chains for the stacking platforms are supported by only two supporting shafts. Four independently movable stacking platforms may be provided, if desired, using only two supporting shafts.

OBJECTS OF THE INVENTION

It is therefore one object of the present invention to provide a novel stacker and gripper conveyor for delivering signatures thereto, which eliminates the need for an intervening belt conveyor.

Another of the present invention is to provide a novel stacker and cooperating gripper conveyor which delivers signatures directly to the stacker to provide more accurate counting and neat stacking of signatures.

Still another object of the present invention is to provide a novel stacker and cooperating gripper conveyor which eliminates the need for an infeed conveyor normally employed in conventional stackers.

Still another object of the present invention is to provide a novel stacker and a cooperating gripper conveyor in which stacking platforms are individually driven by independent variable speed motors to assure accurate counting and neat stacking of signatures.

Still another object of the present invention is to provide a novel stacker and a cooperating gripper conveyor in which the gripper conveyor is provided with a curved delivery section cooperating with a signature guide and gripper release mechanism to facilitate accurate counting and neat stacking of signatures.

Still another object of the present invention is to provide a novel stacker having at least three independently movable drive chains supported by only two shafts.

Still another object of the present invention is to provide a novel arrangement for delivering signatures to a stacking platform by grippers moving over the top of the stacker and then downwardly whereby signatures are moved generally in a direction which generally converges with the direction of movement of the stacking platform receiving signatures before thy are released.

BRIEF DESCRIPTION OF THE FIGURES

The above as well as other objects of the present invention will become apparent when reading the accompanying description and drawings in which.

DETAILED DESCRIPTION OF THE INVENTION AND PREFERRED EMBODIMENTS THEREOF

Figure 1:
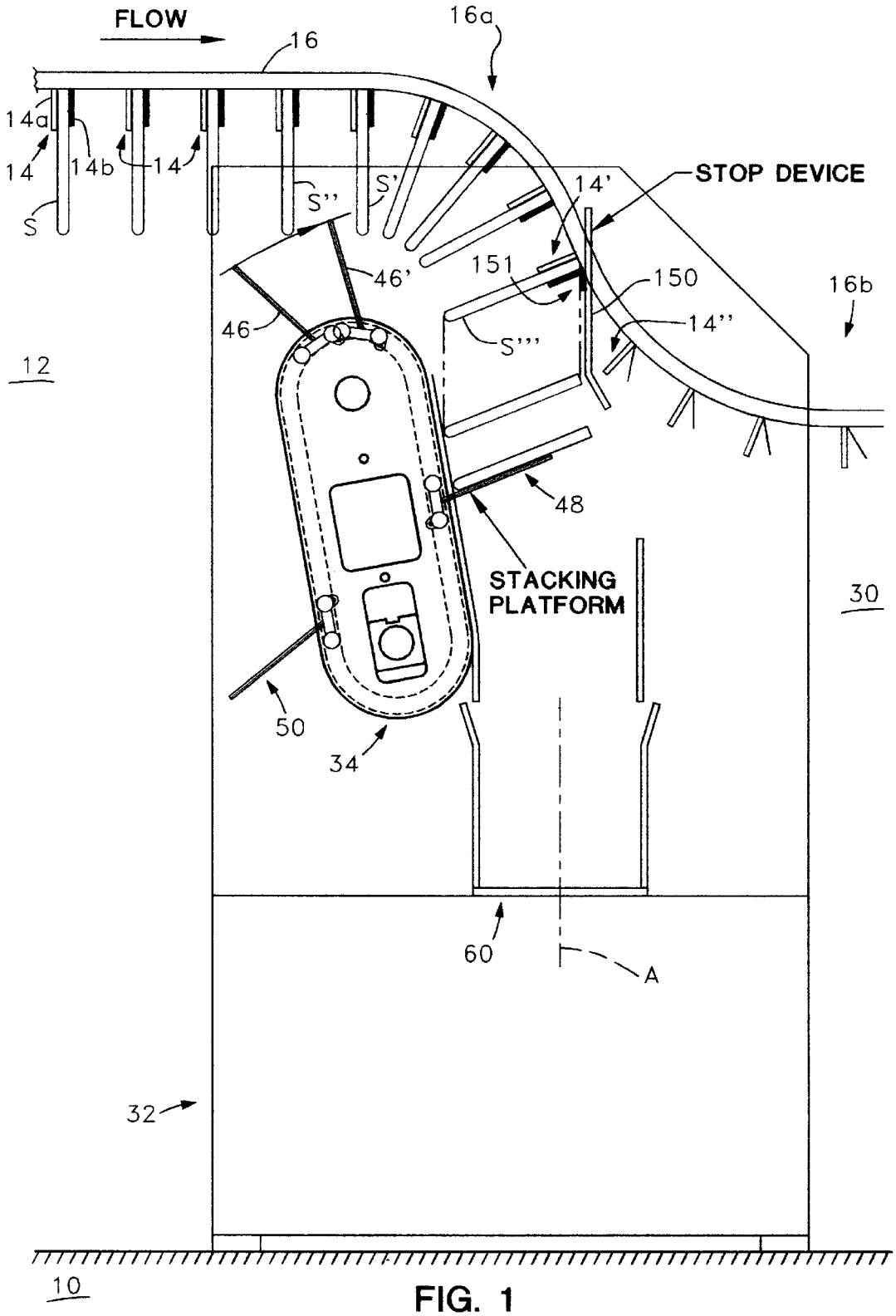
FIGS. 1–5 show elevational views of a stacker and cooperating gripper conveyor designed in accordance with the principles of the present invention, and showing various operating stages of the stacker and gripper conveyor.

FIGS. 1–5 and 9 show apparatus 10 for accurately counting and neatly stacking signatures and the like and being comprised of a gripper conveyor 12 and a cooperating stacker 30.

Gripper conveyor 12 is comprised of a plurality of individual grippers 14 arranged at spaced intervals along a drive chain (not shown) which drive chain lies within guides 16 of a support frame, which guide serves as a guide for the drive chain and grippers.

The individual grippers are each comprised of a pair of jaws 14*a*, 14*b* which grip a signature S at the cut end thereof. The jaws are typically urged toward one another to firmly grip the cut edge end of a signature. A cam follower (not shown), which typically includes a roller, engages an opening cam (not shown) arranged along a guideway to separate jaws 14*a*, 14*b* to drop the signature $S^{111}$. In the preferred embodiment, the grippers 14 and hence the signatures S are aligned substantially perpendicular to guideway 16 so that the folded end of each signature is remote from each gripper 14, each signature being substantially vertically aligned in the section of the guideway 16 approaching stacker 30. However, the signatures need not be precisely held in a vertical orientation and may depart therefrom without diminishing the operating effectiveness of the gripper conveyor.

Any conventional gripper conveyor assembly having the above capabilities and characteristics may be utilized. For example, gripper assembly in U.S. Pat. No. 4,905,818 may be employed. Another suitable gripper employed in a gripper conveyor is shown, for example, in FIGS. 5 and 6 of U.S. Pat. No. 4,723,770.

Guideway 16 is provided with a substantially S-shaped curvature in the region where is passes over and beyond stacker 30, the first section thereof 16*a* curving downwardly toward stacker 30 and the second downstream section 16*b* thereof curving away from the stacker.

Although not shown for purposes of simplicity, it should be understood that the signatures carried by grippers 14 are obtained at an inserter machine, such as a GMA inserter, the grippers 14 gripping each signature at the cut end upon completion of the insertion operation, and conveying the signatures, one signature per gripper, to the region of stacker 30. It should be understood that the distance between the inserter and stacker and the shape of the path assumed by the conveyor guides 16 may vary over a wide range, and is typically a function of the physical plan and arrangement of equipment within a signature printing and handling facility.

Stacker 30 is comprised of a support frame 32 shown in highly schematic fashion for purposes of simplicity. The support frame provides support for, among other components, the main stacker assembly 34 and a rotatably mounted stack receiving bundle forming collector 60, preferably rotatable about vertical axis A in order to permit the formation of compensated bundles, as is conventional.

The main stacker section 34 is comprised of a pair of side plates 36, 38 for supporting drive motors 40, 42 and 44 as well as supporting and guiding the stacking platforms 46, 48 and 50, which will be described in greater detail hereinbelow.

The side plates 36 and 38 (See FIGS. 6–8) have a substantially "race-track" shaped perimeter comprised of a pair of substantially straight, parallel sides and upper and lower substantially semicircular ends. Note, for example, FIG. 6 which shows plate 36 provided with parallel sides 36*a*, 36*b*, and semicircular-shaped upper and lower ends 36*c* and 36*d*. Side plate 38 is designed in a similar fashion. The side plates 36 and 38 are maintained in spaced parallel fashion by spacers 52, 54 secured to side plates 36 and 38 by suitable fasteners F. Although it is preferred that the sides 36*a*, 36*c* be linear, some deviation therefrom will not reduce the effectiveness of the stacking operation, and slight deviation from parallelism and/or slight curvature in path portions 36*a*, 36*c* will not significantly detract from the desired counting and stacking capabilities.

Figure 7:
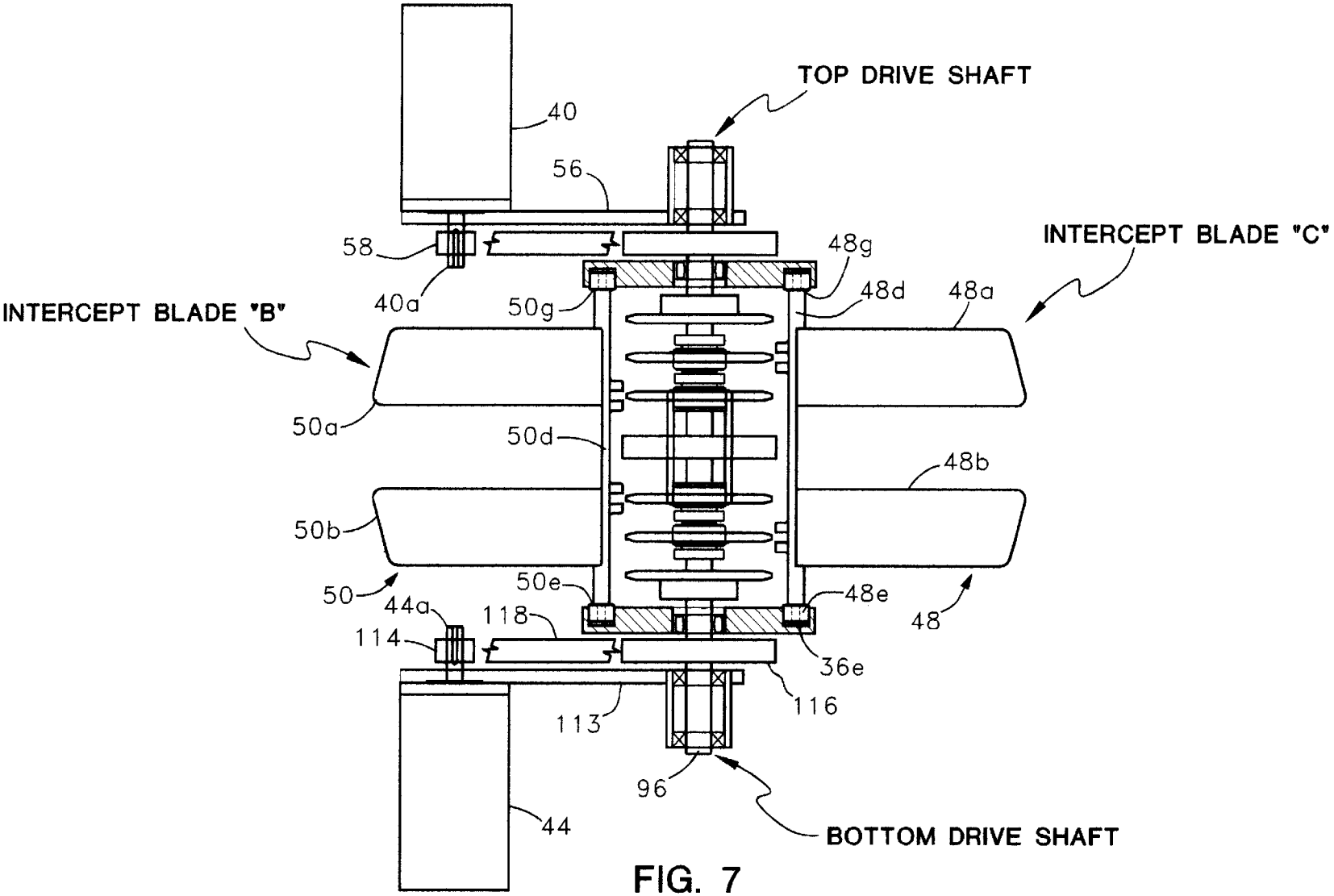
FIG. 7 shows a top view, partially sectionalized of the stacker portion shown in FIG. 6.

Each of the side plates 36 and 38 is respectively provided with a continuous, closed loop race-track shaped recess 36*e*, 38*e* serving as a guideway for slidably receiving the guide rollers of each stacking platform. Noting FIG. 7, two of the three stacking platforms 48 and 50 are shown in FIG. 7, one of which will be described herein in detail, for purposes of simplicity, it being understood that the stacking platforms are similar in design and function.

Figure 6:
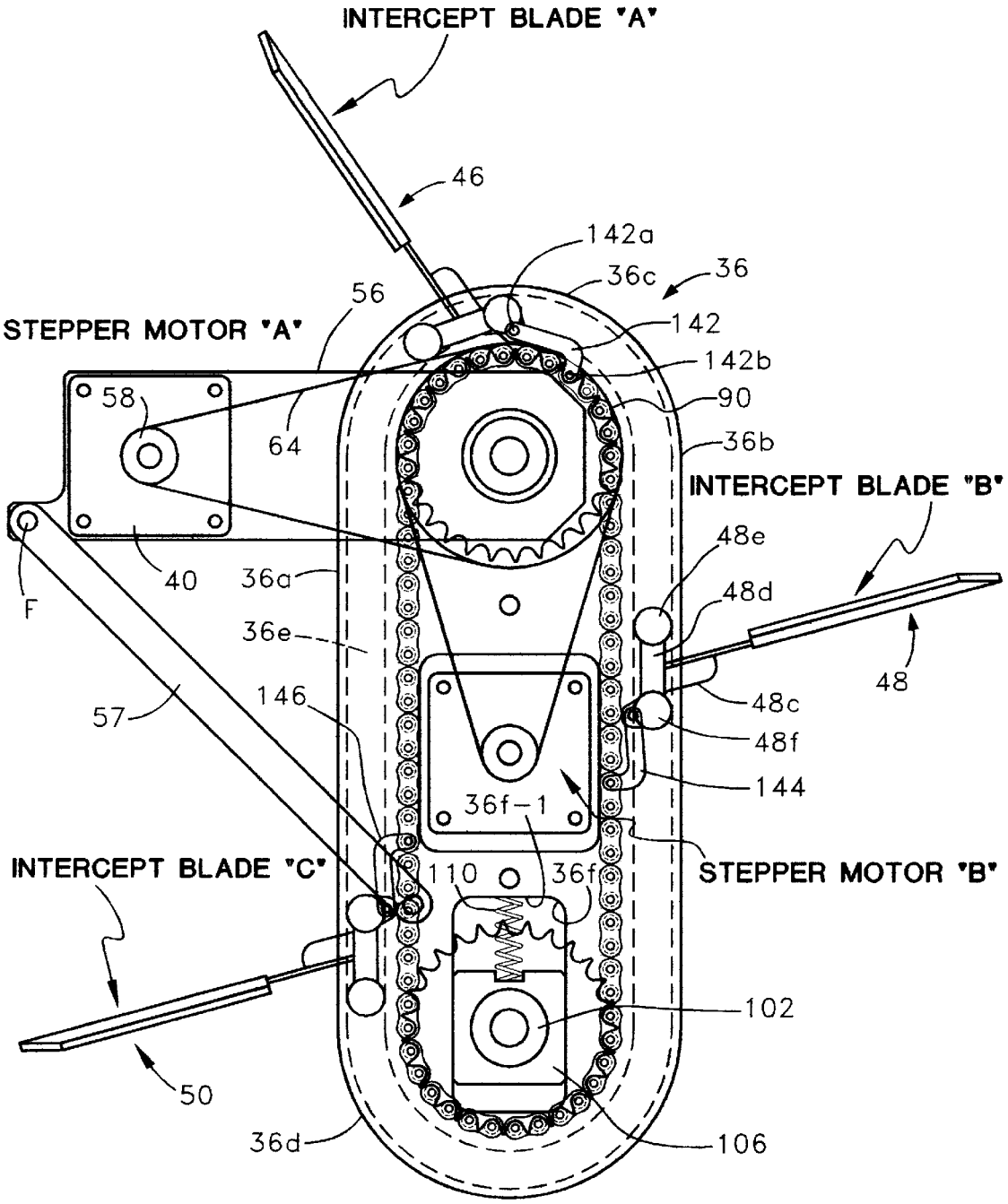
FIG. 6 shows an elevational view of a portion of the stacker of FIGS. 1–5 in greater detail.

Stacking platform 48 is comprised of a pair of intercept blades 48*a*, 48*b* each being secured to one of a pair of support brackets 48*c* extending diagonally away from a diagonally aligned roller supporting plate 48*d*. Brackets 48*c* may be fixedly secured to plate 48*d* by suitable fasteners. Alternatively, brackets 48*c* and plate 48*d* may be cast as a one-piece member. Blades 48*a*, 48*b* are fixedly secured to brackets 48*c* by suitable fasteners. Only one support member 48*d* is shown in FIG. 6, the other support member being hidden from view. The diagonally aligned plate 48*d* is a substantially rectangular-shaped plate having a width which is slightly less than the separation distance between the side plates 36, 38. A pair of freewheelingly mounted rollers 48*e*, 48*f*, which extend into and ride in guideway 36*e* are rotatably mounted to one end of plate 48*d*. A similar pair of freewheelingly mounted rollers 48*g* and 48*h* are rotatably mounted on the opposite vertical surface, roller 48*g* being in view in FIG. 7 and roller 48*h* being hidden from view. The employment of two pairs of rollers (48*e*, 48*f* and 48*g*, 48*h*) for each stacking platform, such as stacking platform 48, assures that the intercept blades 48*a*, 48*b* follow the desired orientation as the stacking platform moves about the guideway driven by the associated pair of drive chains, to be more fully described.

FIG. 6 shows stacking platforms 46, 48 and 50 in three different positions, intercept blade 46 being substantially in the intercept region, stacking platform 48 being in the signature stacking region and stacking platform 50 being in the return region for returning the stacking platform 50 to the intercept region (as will be more fully described).

Each of the stacking platforms is independently driven by an associated drive motor (preferably a stepper motor in one preferred embodiment), drive motor 40 driving stacking platform 46, drive motor 42 driving stacking platform 48 and drive motor 44 driving stacking platform 50 in a manner to be more fully described hereinbelow. The drive motor employed is capable of changing operating speed.

A supporting strut 57 is mounted to one end of motor-supporting bracket 56 by a suitable fastener F. The lower end of strut 57 is secured to the exterior side of side plate 36 by like fastening means.

Motor drive is coupled to each of the stacking platforms by a pair of cooperating chains, there being three pairs of cooperating chains each associated with a stacking platform mounted to move about only two supporting shafts.

Figure 8:
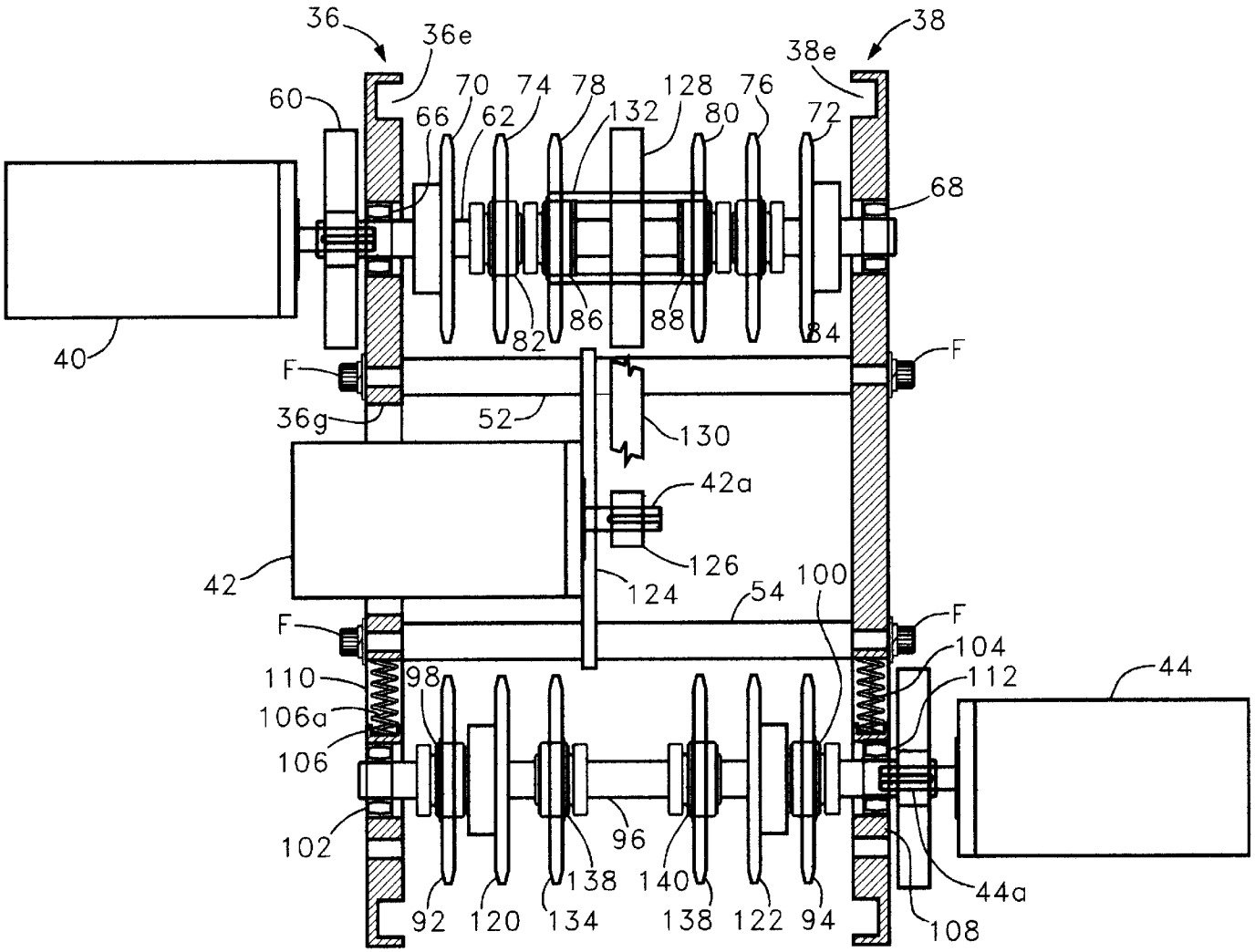
FIG. 8 shows another sectionalized view of the portion of the stacker shown in FIG. 6.

Noting, for example, FIG. 8 and making reference to FIGS. 6 through 8, motor 40 is mounted upon a support bracket 56 so that its shaft 40*a* extends through the support bracket. A pulley 58 is mounted on shaft 40*a*. A driven pulley 60 is mounted to rotate upon upper drive shaft 62. A timing belt 64 is entrained about pulleys 58 and 60 to rotate driven pulley 60. Shaft 62 is mounted to freewheelingly rotate relative to side plates 36 and 38 by means of bearings 66 and 68. Driven pulley 60 is locked to shaft 62. A pair of sprockets 70, 72 are also locked to shaft 62 so as to rotate when driven by stepper motor 40. Two additional pairs of sprockets 74, 76 and 78, 80 are mounted upon shaft 62 but are freewheelingly mounted thereon by means of bearings 82, 84 and 86, 88, enabling the two sets of sprockets 74, 76 and 78, 80 to undergo rotation independently of the rotation imparted to shaft 62 by stepper motor 40.

Drive chains, such as for example, the drive chain 90, have their upper runs entrained about drive sprockets 70 and 72, as well as having their lower runs entrained about driven sprockets 92, 94 which are freewheelingly mounted upon the bottom shaft 96 by bearings 98, 100, respectively.

Shaft 96 is mounted to rotate freewheelingly relative to side plates 36 and 38 by bearings 102 and 104. Bearings 102 and 104 are mounted within slidable plates 106, 108, which are slidably mounted within substantially rectangular-shaped recesses within side plates 36 and 38. Noting, for example FIGS. 6 and 8, slide plate 106, having bearings 102, is mounted within an elongated substantially rectangular-shaped recess 36*f* in side plate 36. A helical spring 110 is under compression and is arranged between the downwardly directed surface of an upper end 36*f*-1 of the opening 36*f* in side plate 36 and the rectangular-shaped upper edge of recess 106*a* provided in a top surface of slide plate 106, serving to normally urge plate 106 downwardly. A similar spring 112 positioned between spacer bar 54 and a recess in the upper surface of slide plate 108 serves substantially the same function. The spring loading of shaft 96 serves to maintain the three pairs of drive chains under proper tension.

Operation of drive motor 40 causes the upper sprockets 70, 72 to rotate, which rotation is imparted to lower sprockets 92, 94 by means of the drive chains, such as for example, drive chain 90. Since bearings 98 and 100 freewheelingly mount lower sprockets 92, 94 on shaft 96, rotation of sprockets 92, 94 is not imparted to shaft 96.

Drive motor 44 is mounted upon a lower end of side plate 38 in a manner similar to the mounting of drive motor 44. More particularly, a support bracket 113 supports drive motor 44 whose shaft 44*a* extends through the bracket. A pulley 114 mounted in shaft 44*a* imparts rotation to a driven pulley 116 locked to shaft 96, by means of timing belt 118. A pair of drive sprockets 120, 122 are fixedly secured to shaft 96 and rotate therewith. A pair of drive chains (not shown for purposes of simplicity) are entrained about lower sprockets 120, 122 and upper sprockets 82, 84. Operation of drive motor 44 causes sprockets 120 and 122 to rotate, driven sprockets 82 and 84, being freewheelingly mounted upon shaft 62, rotate with the rotation of the cooperating drive sprockets 120, 122 through the associated drive chains (not shown for purposes of simplicity).

Drive motor 42 extends through an opening in side plate 36 and is mounted upon a support bracket 124 secured to spacers 52, 54. The drive motor 42 extends through a rectangular-shaped opening 36*g* in side plate 36. The output shaft 42*a* of drive motor 42 extends through support bracket 124 and has a drive pulley 126 secured thereto. A driven pulley 128, rotatable about shaft 62 is rotated by drive motor 42 by way of a timing belt 130 entrained about pulleys 126 and 128.

Sprockets 78 and 80, which are freewheelingly mounted upon shaft 62 by bearings 86 and 88 respectively, are rotated by driven pulley 128 and a hollow cylinder 132 integrally joined to driven pulley 128 and to sprockets 78 and 80. Pulley 128 has a hollow center so that it fits over the outer periphery of the cylinder 132 and is fixedly secured thereto. Rotation of drive motor 42 thus causes sprockets 78 and 80 to be rotated about the central axis of shaft 62 together with pulley 128 and cylinder 130. Suitable drive chains are entrained about upper sprockets 78 and 80 and lower sprockets 134, 136 respectively, which are freewheelingly mounted upon shaft 96 by bearings 136 and 138, respectively. If desired, a fourth stacking platform moved by a fourth set of drive chains may be provided employing the technique used for the drive chains employed with the freewheelingly mounted sprocket pairs 82, 84 and 120, 122, by shifting these sprockets along their respective shafts toward one of the side plates to provide room for a fourth set of drive chains and sprockets therefor.

With the novel arrangement shown in FIGS. 6–8, each pair of drive chains may be driven independently of one another, and at different, variable speeds.

Each of the stacking platforms is joined to an associated pair of drive chains by means of a pair of substantially L-shaped links. For example, stacking platform 46 is joined to its associated drive chains by a pair of L-shaped links 142, stacking platform 48 being joined to its associated drive chains by a pair of L-shaped links 144 and stacking platform 50 being joined to its associated pair of drive chains by a pair of L-shaped links 146. Only one L-shaped link of each pair is shown in FIG. 6, the other one being hidden from view. Each L-shaped link is coupled to its associated stacking platform by a first pin 142*a* and is coupled to its associated drive chain by a pin 142*b* extending through the drive chain. Thus, each stacking platform may be moved independently of the others, and at a variable speed, suitable control being provided so as to prevent each of the stacking platforms from "passing" another one of the stacking platforms.

Making reference to FIGS. 1–5 and 9, as well as FIGS. 6–8, the gripper conveyor guideway 16 curves downwardly to bring the grippers 14 and hence the signatures immediately in front of the stacking region, as well as aligning the signatures to move in generally the same direction as the movement of a stacking platform through the stacking region so that the directions of movement of signatures generally converge with the direction of movement of a stacking platform in the stacking region.

A substantially, vertically aligned vertical stop device 150 is arranged on guideway 16 and is located in close proximity to a release mechanism 151, such as a cam, arranged to open the jaws of each gripper as it reaches the position occupied by gripper 14'. Grippers 14 are preferably provided with an arm having a cam follower roller which moves the jaws 14*a*, 14*b* apart when the cam follower engages a cam surface (not shown) of the release mechanism, releasing a signature S to drop downwardly toward the stacking platform moving along the stacking region. Stop device 150 assures that the signatures will move vertically downward upon a stacking platform after the signature carried by the gripper is released to fall downwardly by gravity. Gripper 14', shown in FIG. 1, occupies a position just prior to release of the gripper. Gripper 14" represents a gripper which has been opened and has passed the stop device 150.

Figure 10:
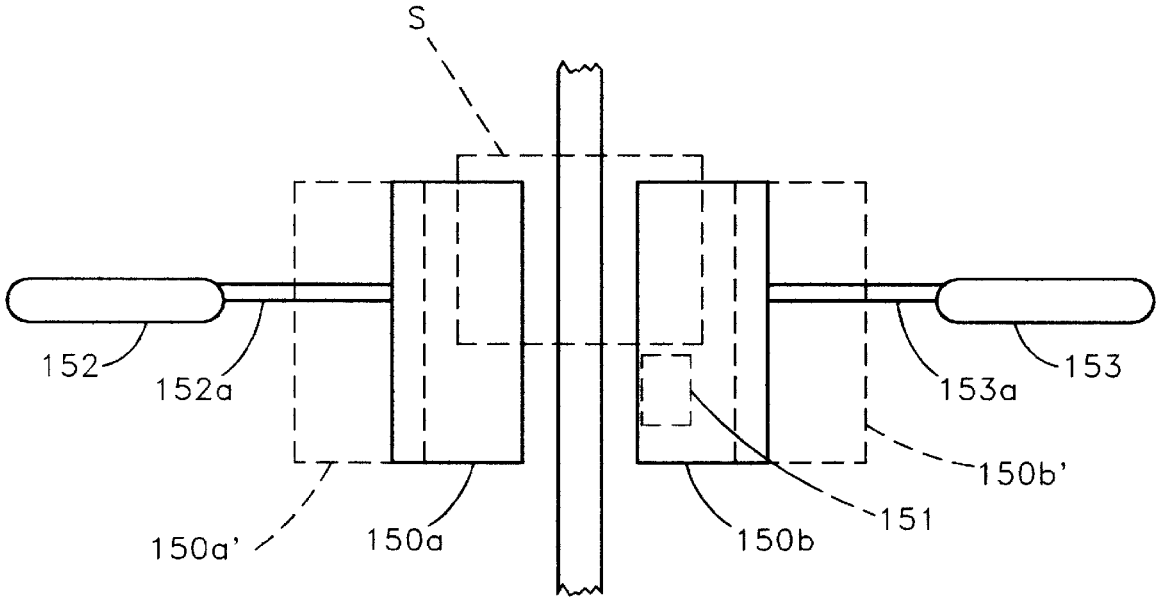
FIG. 10 is a simplified view showing a reciprocatable stop device which may be employed in the embodiments of FIGS. 1–5 and 9.

The stop device 150 as shown in FIG. 10 is preferably comprised of a pair of plates arranged on opposite sides of guideway 16, the spacing between the pair of plates being sufficient to permit guideway 16 and grippers 14 to pass therethrough.

The plates 150*a*, 150*b* may be reciprocally mounted, as shown in FIG. 10, to permit selected signatures to be diverted to another stacker downstream, if desired. The gripper release mechanism 151 is also disabled at this time. One technique for disabling the release mechanism 151 is by mounting it upon one of the plates 150*b* thereby moving it away from the path of oncoming grippers 14. The plates 150*a*, 150*b* may be moved by cylinders 152, 153 which have piston rods 152*a*, 153*b* to move plates 150*a*, 150*b* between the solid-line position and dotted line position 150*a*', 150*b*'.

Stacking platform 48 shown in FIG. 1 collects signatures released from the grippers 14 as they fall due to gravity. The stacking platforms are moved in a path generally similar to the trajectory of released signatures (see signature $S^{111}$ of FIG. 1) with the downward movement of the stacking platform creating space for subsequent signatures. The curved guideway 16 contributes to the proper alignment by the downward curvature in the region adjacent to the stacking region. The rate at which stacking platform 48 is moved through the stacking region is variable and is primarily a function of the throughput of the gripper conveyor 12 and signature thickness. The intercept cycle and stacking cycle are determined by the gripper conveyor throughput and signature thickness. The velocity of the stacking platform is controlled by the velocity of gripper conveyor by means of an Electronic Infinite Variable Gear Box (EIVGB). The ratio of the EIVGB is set by the thickness of the signatures and the throughput of the gripper conveyor. The EIVGB comprises electronic means device including software, which receives a pulse train from the gripper conveyor and has typically manually inputted thereto signature thickness data, and utilizes this information to operate the stepper motors to achieve the desired speeds at each and every portion of the stacking cycle. One typical EIVGB, which may be employed, is produced by Pacific Scientific of Rockford, Ill. However, any other EIVGB may be employed, if desired. The intercept cycle is triggered by the pulses derived from the gripper conveyor representing conveyor speed and the velocity of the stacking platform in the stacking region is chosen so as to be a substantially 1:1 ratio relative to the velocity of the gripper conveyor. In the stacking cycle phase, the velocity of the stacking platform is a function of the gripper velocity and the thickness of each signature.

When a predetermined quantity of signatures to be collected on stacking platform 48 is detected, a controller which operates all three drive motors 40, 42 and 44, moves platform 46 from the intercept ready position to the intercept position 46' shown in FIG. 1 thereby moving between the last signature S' to be stacked upon stacking platform 48 and the first signature S" to be stacked upon stacking platform 46.

The novel arrangement of the present invention, by delivering signatures "over the top" of stacker 34 and then downwardly, moves the signatures generally in the direction of movement of the stacking platform 48 (see FIG. 1). In conventional stackers the folded edges of the signatures strike directly against a back surface of the stacking platform. Each signature undergoes free fall as it leaves the conventional infeed conveyor and before it strikes the back plates of a conventional stacking platform. The signature undergoes "V-ing" (i.e. is bent into a V-shape), and as a result, is stiffened to assure that it follows a desired trajectory. Signatures with inserts and especially signatures with a number of inserts are difficult to bend and hence stiffen and are thus more difficult to control. Also, signatures that strike the back plate tend to rebound therefrom and are more difficult to stack neatly.

By moving signatures along a downward diagonal path as they approach the stop plates 150, the velocity vector in the horizontal direction is smaller than the velocity vector in the downward vertical direction. The downward vertical velocity vector is generally in alignment with the stacking direction and contributes to the formation of a neat stack. Also, the cut edge which engages the stop plate, is more flexible than the folded edge and does not rebound by any significant amount, especially due to the small velocity vector of the signature in the horizontal direction. The orientation of the gripper at the stop device 150 (see grippers $14^1$ in FIG. 1) further significantly reduces the velocity vector in the horizontal direction. All of these features contribute to the neat stacking of signatures, none of which features are found in conventional devices.

Figure 2:
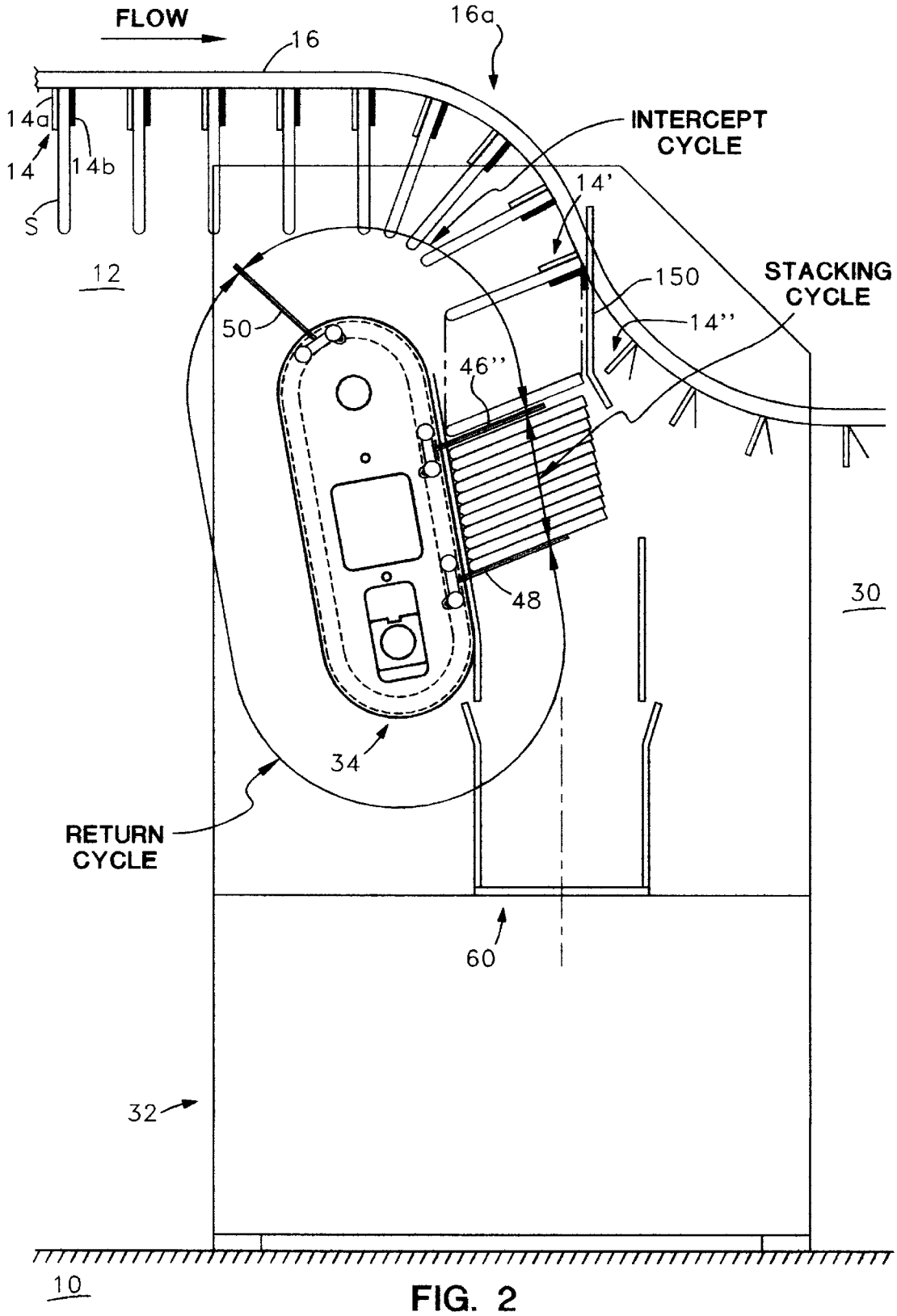

Stacking platform 46 moves along a path similar to the path taken by the incoming signatures, and at the proper time becomes the next stack support, and stacking platform 46 now occupies the position 46" shown in FIG. 2.

Figure 3:
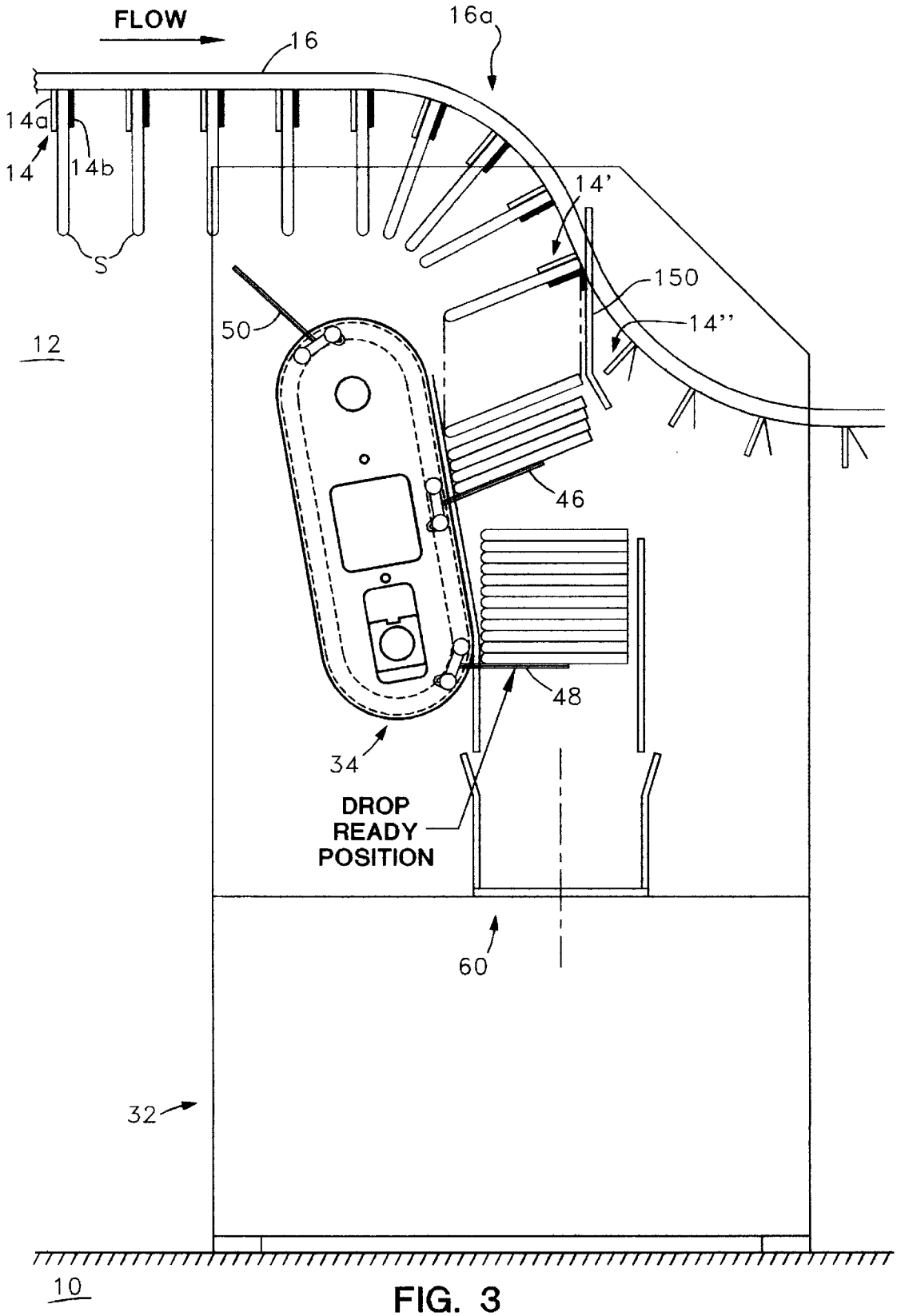
Figure 4:
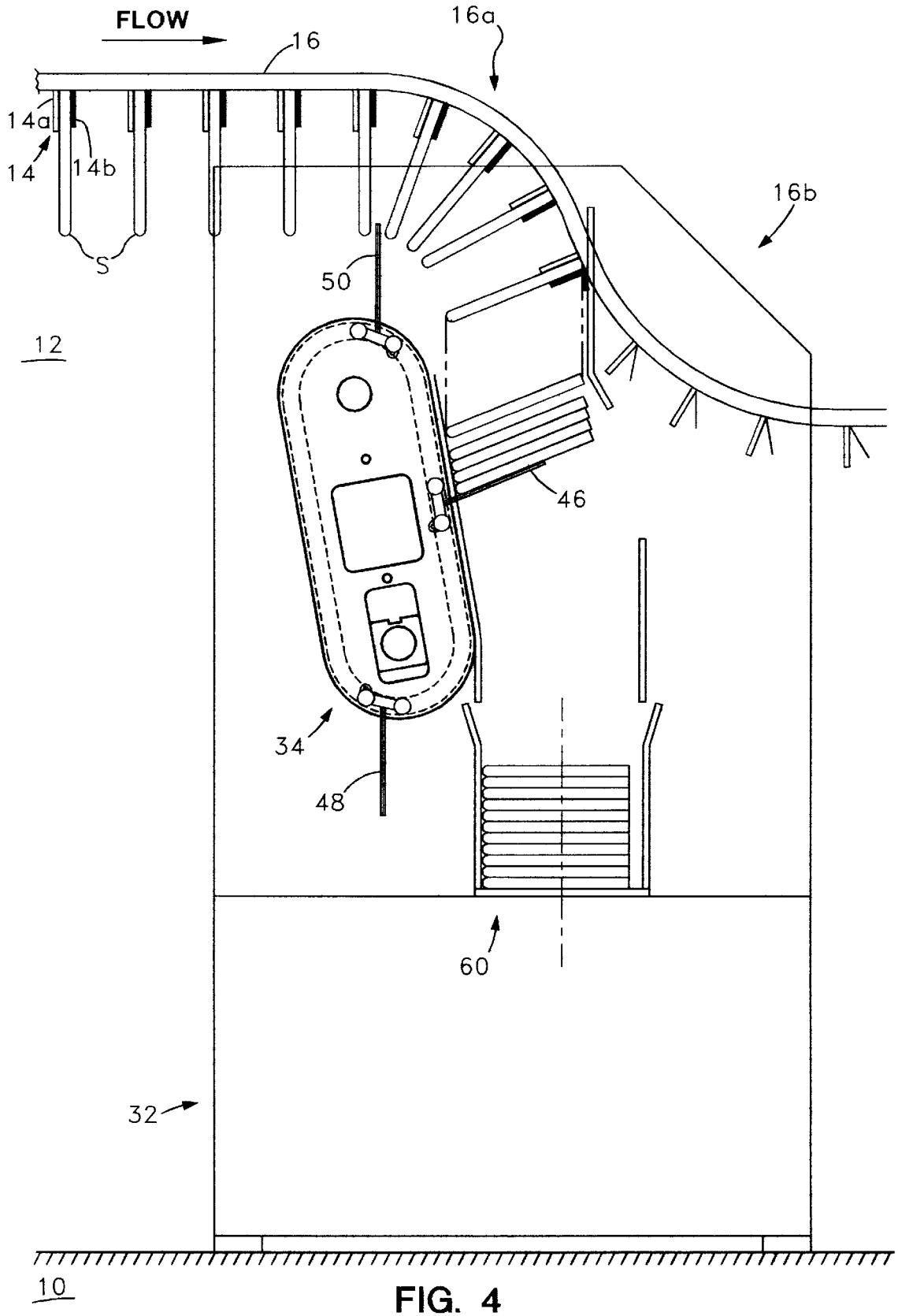

As the stacking process continues, the preceding stack formed upon stacking platform 48 is moved downwardly towards its drop-ready position at which time the intercept blades of stacking platform 48 are almost horizontal, as shown in FIG. 3. At this time, the drive motor operating stacking platform 48 has its output increased to cause stacking platform 48 to be quickly pulled away from beneath the signature stack, i.e. at a rate faster than the signatures can drop by gravity, thereby leaving the stack unsupported so as to experience free-fall, due to gravity, into the bundle forming collector 60 as shown in FIG. 4, stacking platform 48 having moved to the position shown in FIG. 4, free of the bundle forming collector 60. In a preferred embodiment, bundle forming platform 60 is rotated through one-half turn after receiving a stack of signatures from a stacking platform in order to form a compensated bundle, as is conventional.

Figure 5:
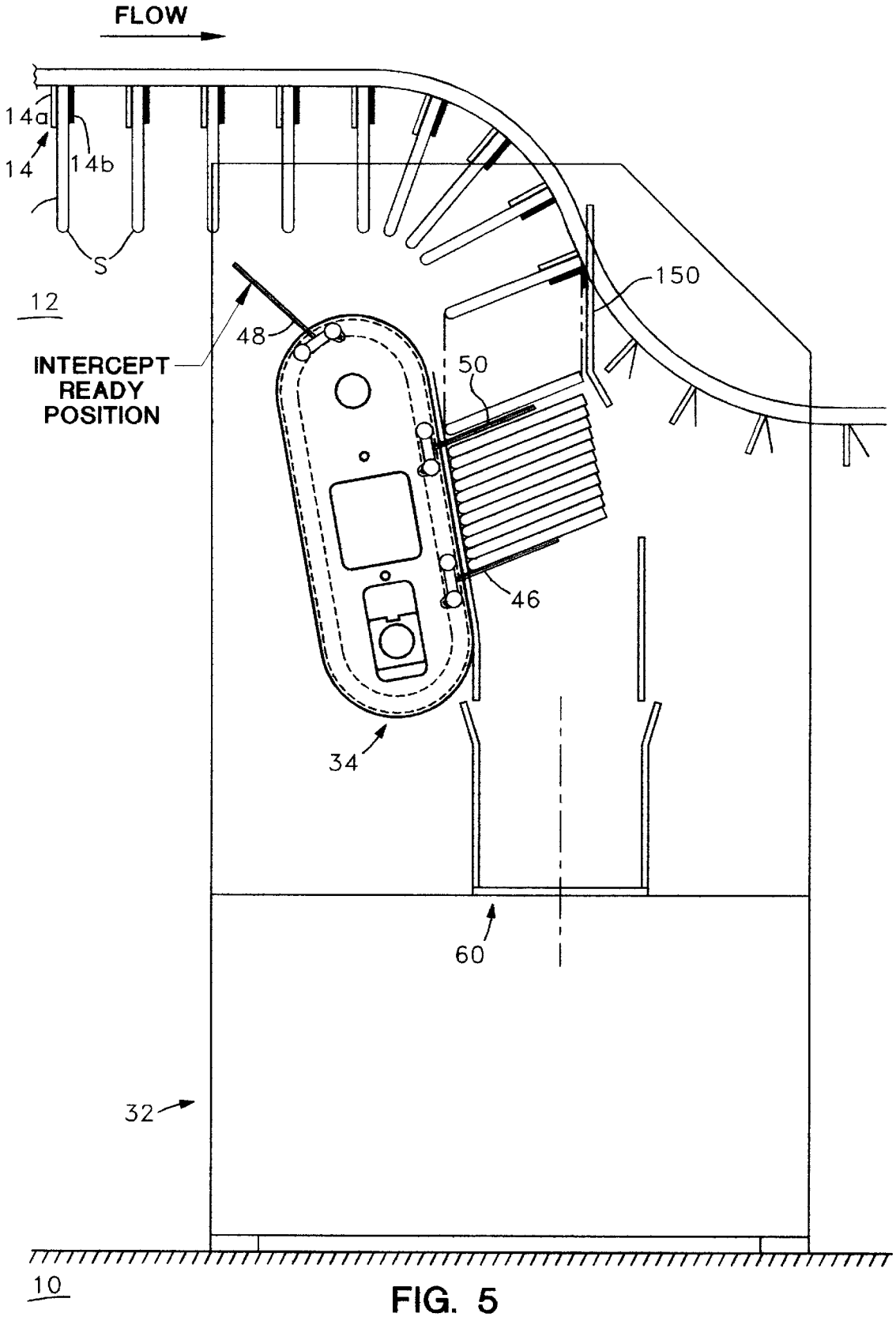

The stacking platform 50, which is pulled away from the preceding signature stack, is moved quickly toward the intercept ready position shown in FIG. 5 in readiness to be moved into the flow of signatures as shown by the intercept-ready position of stacking platform 50 at FIG. 4. The return cycle velocity of the stacking platforms are controlled by the stacker controller.

The above cycles are repeated in cooperation with a flow of signatures delivered by the gripper conveyor.

Upon completion of a bundle of either compensated or uncompensated type, the completed bundle is pushed off of the bundle forming collector 60 by a conventional pusher (not shown), forming part of the stacker, onto a suitable conveyor for wrapping and tying bundles, for example.

Figure 9:
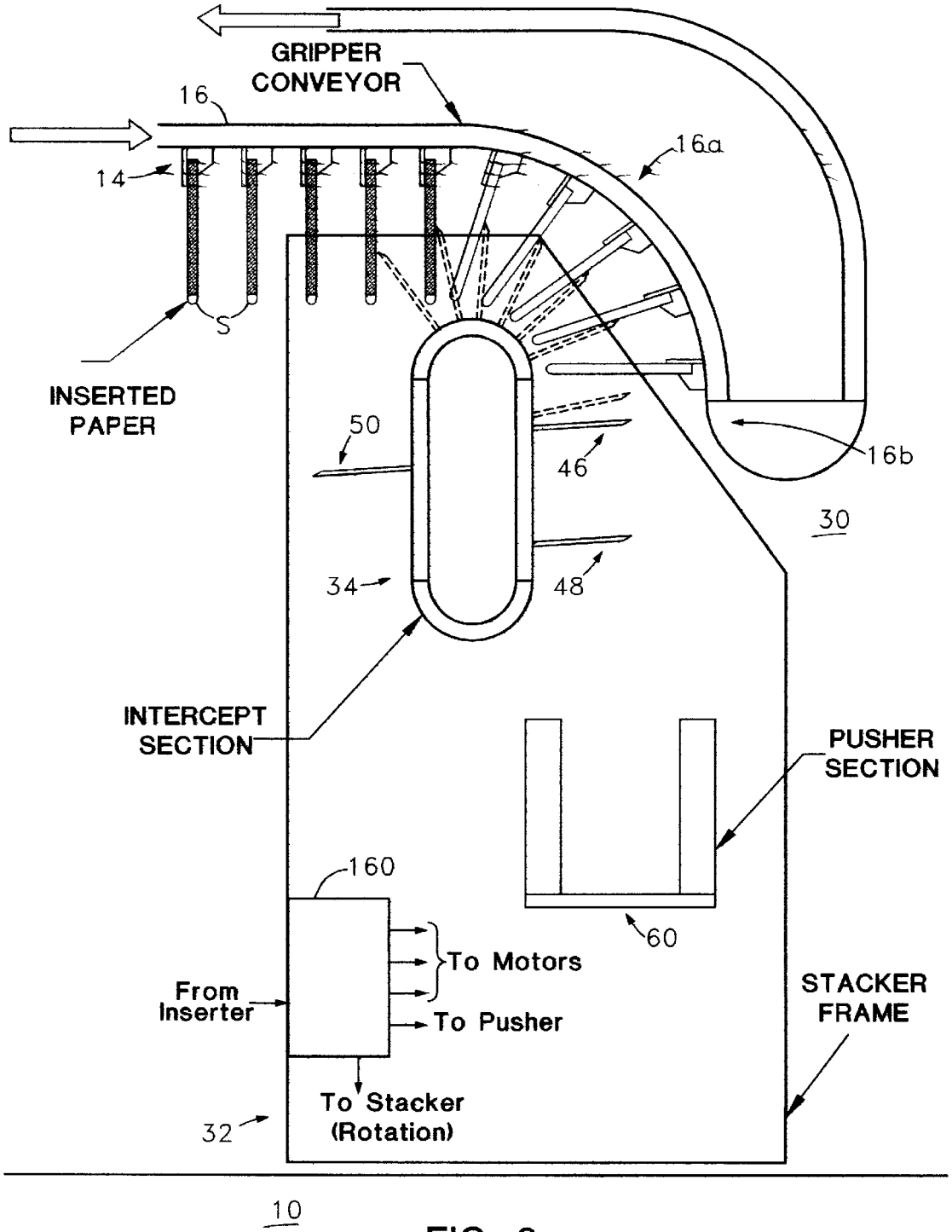
FIG. 9 shows a simplified view of a stacker and cooperating gripper conveyor of the type shown in FIGS. 1–5 showing further features thereof.

The throughput of the gripper conveyor is provided to a controller 160, shown, for example, in FIG. 9. Data identifying the signature thickness and number of signatures being delivered by the gripper conveyor, such as, for example, every gripper, every second gripper, every third gripper, etc. is delivered to controller 160. Constant, known data comprising the distance between the inserter and the stacker 30 is also utilized to control drive motors 40, 42 and 44, the rotation of bundle forming platform 60 and the pusher for pushing completed bundles from bundle forming platform 60. Signature thickness may be inserted into the controller 160 by a suitable keyboard or touchscreen, for example.

The use of stepper motors as the drive motors provides a precise manner of knowing exactly where each stacking platform is located according to the number of pulses supplied to each stepper motor. Alternatively, other types of variable speed motors can be used, each motor operating together with an encoder to detect the position of each platform. Such encoders produce pulses representative of the position of a platform as well as providing an index pulse to identify a specific location, such as the intercept-ready position. The encoders may include rotatable members driven by their associated drive motor output shaft or by one of the shafts driving the associated drive chain.

As shown in FIG. 9, the gripper conveyor is designed to return grippers to the inserter location to continue the delivery and stacking procedure.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Apparatus for stacking signatures comprising:

a stacking platform for receiving signatures;

means for guiding said stacking platform along a closed-loop path including a first substantially linear path portion defining a stacking region for guiding said stacking platform downwardly therealong, a second linear path portion arranged substantially parallel to said first linear path portion, and substantially semi-circular path portions linking said linear path portions at their upper and lower ends;

drive means including a motor for moving said stacking platform about said closed-loop path;

gripper conveyor means for conveying signatures comprising a plurality of grippers arranged at spaced intervals and guide means for guiding said grippers to move towards said stacking apparatus, and to pass over said stacking apparatus and along a downwardly curved path toward said stacking region;

said stacking platform having intercept blade means with a free end for moving between adjacent signatures guided along said path by said grippers in a region generally above the upper end of said closed-loop path and as said stacking platform moves along the upper semi-circular path portion;

said grippers being movable between a gripping and a releasing position; and release means for causing a gripper to release a gripped signature to fall toward said stacking platform as the gripper being released passes a given location along said curved path.

2. The apparatus of claim 1 further comprising a stop device arranged in the vicinity of the releasing position for limiting movement of a released signature downwardly toward a stacking platform moving through the stacking region.

3. The apparatus of claim 2 further comprising means for selectively displacing said stop device away from a path of signatures being carried by said gripper conveyor means and for disabling said gripper releasing means to enable signatures to pass to a downstream location beyond said stacking region.

4. The apparatus of claim 1 wherein said gripper guide means comprises a closed loop path for returning grippers which have delivered signatures to the stacking platform to a loading location for receiving signatures thereat.

5. The apparatus of claim 4 wherein means are provided for transferring signatures to said grippers upon completion of an insertion operation by insertion means.

6. The apparatus of claim 1 wherein said guide means for guiding said grippers moves said grippers along a first path portion above the stacking platform wherein the signatures are suspended downwardly from each gripper having downward ends spaced apart by a substantially uniform distance;

said guide means having a second path portion comprising said downwardly curved path wherein downward ends of the signatures are moved closer to one another;

said intercept blade means moving between adjacent signatures along said first path portion and prior to signatures reaching said second path portion.

7. The apparatus of claim 6 wherein the spacing between the downward ends of signatures moved by grippers along said first path portion is sufficient to enable a free end of intercept blade means to enter a gap region between adjacent signatures.

8. The apparatus of claim 1 wherein said means for guiding comprises cam means conforming to said closed-loop path; and said stacking platform having cam follower means slidably engaging said cam means to properly orient said intercept blade means as the stacking platform moves along the closed-loop path.

9. The apparatus of claim 1 wherein said guide means provides a second curved path downstream said first mentioned downwardly curved path to move grippers away from the stacking region after each gripper has released a signature.

10. Stacking apparatus for stacking signatures, comprising:

first, second and third stacking platforms;

first, second and third independent drive means for respectively driving said first, second and third platforms;

control means for operating said first, second and third drive means and comprising:

means for moving one of said first, second and third platforms to a home position extending upwardly toward signatures moving along a path above said stacking apparatus while another one of said first, second and third stacking platforms moving along a stacking region is receiving signatures;

means responsive to a predetermined signature count for rapidly moving one of the stacking platforms in the home position to a stream intercepting position between a predetermined signature moving above said stacking apparatus and which is to be delivered to one of the stacking platforms moving through the stacking region and a signature upstream of said predetermined signature and which is to be a first signature received by one of the stacking platforms which has moved to the intercepting position;

means for moving one of the stacking platforms leaving the stacking region about a lower curved path to move the stacking platform leaving the stacking region out from beneath a stack of signatures supported thereon to enable the stack of signatures supported thereon to drop upon a collector; and means for moving one of the stacking platforms upwardly toward said home position in readiness to move to the intercepting position to control an amount of signatures delivered to one of the stacking platform in the stacking region.

11. Apparatus for conveying, counting and stacking signatures delivered to a take off location by a plurality of grippers arranged at spaced intervals, each gripper gripping a cut end of a signature, each signature being suspended from its associated gripper with a folded edge extending generally downwardly therefrom;

a stacker for stacking signatures;

said grippers moving along a path above said stacker and having a curved path portion curving generally downwardly as the grippers pass a region near a top of said stacker so as to move in a direction which generally converges with a direction of movement of a stacking platform moving downwardly through a stacking region;

said stacker having at least first and second stacking platforms movable about a substantially oval-shaped closed-loop path;

control means for independently moving said stacking platforms so as to move one of said stacking platforms downwardly through said stacking region and moving another one of said stacking platforms upwardly towards signatures being moved above said stacker by grippers;

said control means further including means for moving the upwardly moving stacking platform along a curved path portion and into an intercept position between adjacent signatures carried by grippers causing a signature downstream of the stacking platform in the intercept position to be a last signature collected on the stacking platform moving through the stacking region and causing a signature upstream of the stacking platform in the intercept position to be a first signature collected upon the stacking platform in the intercept position when it moves into the stacking region; and means engaging each gripper as it passes a given location along said curved path to release a signature gripped thereby, enabling the released signature to fall toward a stacking platform moving downwardly through the stacking region.

12. The apparatus of claim 11 further comprising stop means positioned along said curved path of said grippers to deflect a signature released by a gripper downwardly toward a stacking platform moving downwardly through the stacking region.

13. The apparatus of claim 12 wherein said means for independently moving said stacking platforms is comprised of separate drive motor means for each stacking platform for independently controlling movement of its associated stacking platform.

14. The apparatus of claim 13 wherein said drive motor means are variable speed motors.

15. The apparatus of claim 13 wherein an output speed of each of said drive motor means is controlled by electronic infinite variable gear box means.

16. Stacker apparatus for accumulating signatures comprising a pair of substantially oval-shaped side plates each having a substantially oval-shaped guide cam;

means for maintaining said side plates in spaced parallel fashion;

at least first and second stacking platforms each having first and second pairs of cam followers, said first pair of cam followers being slidable along the cam groove in one of said side plates and said second pair of cam followers being slidable along the cam groove in another one of said side plates;

a first shaft arranged near a top end of said side plates and first bearing means for rotatably freewheelingly mounting said first shaft relative to said side plates;

a second shaft mounted near a bottom end of said side plates and second bearing means for rotatably freewheelingly mounting said second shaft relative to said side plates;

first and second pairs of sprockets arranged on said first shaft;

third and fourth pairs of sprockets arranged on said second shaft;

said first pair of sprockets being secured to said first shaft for rotation therewith;

third bearing means for rotatably freewheelingly mounting said second pair of sprockets to said first shaft;

said third pair of sprockets being secured to said second shaft for rotation therewith;

fourth bearing means for rotatably freewheelingly mounting said fourth pair of sprockets to said second shaft;

a first drive chain being entrained about one of said first pair of sprockets and one of said fourth pair of sprockets;

a second drive chain being entrained about a remaining one of said first pair of sprockets and a remaining one of said fourth pair of sprockets;

a third drive chain being entrained about one of said second pair of sprockets and one of said third pair of sprockets;

a fourth drive chain being entrained about a remaining one of said second pair of sprockets and a remaining one of said third pair of sprockets;

whereby rotation imparted to said first shaft by a first drive means moves said first and second drive chains and whereby rotation imparted to said second shaft by a second drive means moves said third and fourth drive chains independently of movement of said first and second drive chains;

first coupling means for coupling said first stacking platform to at least one of said first and second drive chains;

second coupling means for coupling said second stacking platform to at least one of said third and fourth drive chains;

a fifth pair of sprockets and fifth bearing means for rotatably freewheelingly mounting said fifth pair of sprockets upon said first shaft;

a sixth pair of sprockets and sixth bearing means for freewheelingly mounting said sixth pair of sprockets upon said second shaft;

said fifth pair of sprockets being joined to sprocket joining means to rotate in unison;

a driven pulley joined to said sprocket joining means for rotating said fifth pair of sprockets under control of a third drive motor means;

a fifth drive chain being entrained about one of said fifth pair of sprockets and one of said sixth pair of sprockets;

a sixth drive chain being entrained about a remaining one of said fifth pair of sprockets and a remaining one of said sixth pair of sprockets; and a third stacking platform and coupling means for linking said third stacking platform to said fifth and sixth drive chains;

whereby said third stacking platform, having cam follower means slidably arranged within said cam means, is movable along said closed-loop path independent of said first and second stacking platforms.

17. The apparatus of claim 16 wherein said sprocket joining means is a cylinder, said driven pulley being secured to an outer periphery of said cylinder, said driven pulley, said cylinder and said fifth pair of sprockets being rotated in unison.

18. The apparatus of claim 17 further comprising means for movably mounting one of said shafts relative to a remaining one of said shafts and bias means for urging the movably mounted shaft in a direction away from the remaining one of said shafts to maintain all of said drive chains at a suitable tension.

19. Stacker apparatus for accurately counting and neatly stacking signatures thereon, comprising:

a plurality of stacking platforms arranged to move about a closed substantially oval-shaped, closed-loop path comprised of a pair of substantially straight parallel portions and substantially semi-circular shaped portions respectively arranged at the upper and lower ends of said parallel portions;

means for independently and successively moving the stacking platforms upwardly along one of said straight portions and around the upper semicircular-shaped portion which collectively constitute a return path and an intercept region respectively, and downwardly along a remaining one of the straight portions which constitutes a stacking region;

conveyor means for moving signatures at spaced intervals along a path above said upper semi-circular-shaped portion and then along a downwardly curved conveyor path so as to move said signatures in a direction which substantially converges with the direction of movement of a stacking platform through said stacking region; and means for dropping each signature as it moves along said downwardly curved path and is above the stacking region.

20. The apparatus of claim 19 wherein said conveyor means comprises a gripper conveyor provided with grippers for gripping a signature, said grippers being movable between a gripping and a release position; and said means for dropping comprises means for moving each gripper to the release position as it passes a given location along the downwardly curved conveyor path whereby a released signature drops downwardly toward a stacking platform in the stacking region.

21. A stacker for stacking signatures comprising:

first and second rotatable shafts;

first, second and third drive chain sets;

means arranged on said first and second shafts for mounting said first, second and third drive chain sets so that each drive chain set is movable independently of the movement of all remaining drive chain sets; and a stacking platform coupled to each of said drive chain sets for receiving and stacking signatures delivered thereto.

22. The stacker of claim 2 wherein said means for mounting includes:

a first set of drive sprocket means provided on said first and second rotatable shafts for moving the first set of drive chains by rotation of said first drive shaft, a second set of drive sprocket means arranged on said first and second shafts for moving the second set of drive chains by rotation of said second drive shaft, and a third set of drive sprocket means freewheelingly mounted on said first and second rotatable shafts for moving the third set of drive chains regardless of rotation or non-rotation of said first and second drive shafts, first and second drive motors respectively coupled to independently drive said first and second shafts, and a third drive motor coupled to said third set of drive sprocket means for independently rotating said third set of drive sprocket means.

23. The stacker of claim 22 further comprising a pulley integrally joined to said third set of drive sprocket means; and a belt coupling an output of said third drive motor to said pulley.

24. A method for stacking signatures, comprising the steps of:

(a) moving at least two stacking platforms arranged at spaced intervals about a closed loop path comprised of two substantially linear path portions and two substantially semi-circular shaped path portions, said stacking platforms being moved so that each platform is successively moved downwardly along one of said linear path portions which comprises a stacking region and moved along one of the semi-circular path portions joining lower ends of said substantially linear path portions and thereafter moved upwardly along a remaining one of the substantially linear path portions comprising a return region and thereafter moved about a remaining one of said substantially semi-circular shaped path portions joining upper ends of said substantially linear path portions to return to an upper end of the linear path portion which comprises the stacking region;

(b) holding signatures along a cut edge thereof so that a folded edge thereof extends downwardly;

(c) moving the held signatures at spaced intervals along a path which passes above an upper end of the closed-loop path and thereafter moving the held signatures downwardly as they pass over said upper end so that each held signature moves in a direction which substantially converges with a direction of movement of a stacking platform as it moves along the stacking region; and (d) releasing each signature at a given point along said downward path whereby a released signature falls toward the stacking platform moving through the stacking region so as to be collected thereon.

25. The method of claim 24 further comprising moving a stacking platform out from under a stack of signatures collected thereon as the stacking platform leaves the stacking region and moves along the substantially semi-circular-shaped path portion extending between the lower end of the path representing the stacking region and the lower end of the linear path representing the return region to permit a stack of signatures deposited thereon to be dropped downwardly to a collection region.

26. The method of claim 25 further comprising moving a platform entering the return region toward the upper end of the closed-loop path in readiness for collecting a stack of signatures thereon.

27. The method of claim 24 further comprising restraining movement of each released signature to guide movement of each released signature downwardly toward a stacking platform in the stacking region.

28. The method of claim 24 further comprising moving a stacking platform not collecting signatures upwardly toward signatures passing over the upper end of the closed-loop path so that a free end thereof intercepts the signature path and moves between a signature which is a last signature to be delivered to a stacking platform moving through the stacking region and a signature upstream from said last signature and which is to be a first signature collected on the stacking platform intercepting the signature path.

* * * * *

UNITED STATES PATENT AND TRADEMARK OFFICE

CERTIFICATE OF CORRECTION

PATENT NO. : 5,772,391
DATED : June 30, 1998
INVENTOR(S) : Sjogren et al

It is certified that error appears in the above-identified patent and that said Letters Patent is hereby corrected as shown below:

Col. 3, line 21, delete "thy" and insert --they--. our mistake

Col. 12, line 3, delete "the stacking platform" and insert instead --one of of the stacking platforms--. PTO mistake Col. 14, line 32, delete "claim 2" and insert instead --claim 21--. PTO mistake Signed and Sealed this Twenty-eighth Day of September, 1999

*Attest:*

Q. TODD DICKINSON

*Attesting Officer*

*Acting Commissioner of Patents and Trademarks*